US006398402B1

(12) United States Patent
Thomas et al.

(10) Patent No.: US 6,398,402 B1
(45) Date of Patent: Jun. 4, 2002

(54) DISPOSABLE DISRUPTOR AGITATOR TOOL HAVING A BLADED ROTOR DISPOSED IN A STATOR

(76) Inventors: Chris Thomas; Spencer Smith; Chris Gambino, all of 1800 Sandy Plains Ind. Pkwy., Suite #204, Marietta, GA (US) 30006

( * ) Notice: Subject to any disclaimer, the term of this patent is extended or adjusted under 35 U.S.C. 154(b) by 0 days.

(21) Appl. No.: 09/022,094

(22) Filed: Feb. 11, 1998

(51) Int. Cl.[7] ..... B01F 7/00

(52) U.S. Cl. ..... 366/129; 366/266; 366/305

(58) Field of Search ..... 366/129, 264, 366/266, 305, 302, 318; 241/246; 435/306.1

(56) References Cited

U.S. PATENT DOCUMENTS 2,038,221 A * 4/1936 Kagi
2,541,221 A * 2/1951 Edwards
2,789,800 A * 4/1957 Willems
3,137,481 A * 6/1964 MacLean
3,298,411 A * 1/1967 Rosett
3,724,765 A * 4/1973 Rohrbaugh et al.
3,912,179 A * 10/1975 Hartig, Jr. et al.
4,002,326 A * 1/1977 Brogli et al.
4,307,846 A * 12/1981 Spelsberg ..... 241/246
4,441,824 A * 4/1984 Brokaw ..... 366/266
4,745,068 A * 5/1988 Godfrey et al. ..... 366/266
4,828,395 A * 5/1989 Saito et al. ..... 241/246
5,731,199 A * 3/1998 Roggero ..... 435/306.1
5,758,964 A * 6/1998 Grainal ..... 366/266

* cited by examiner

*Primary Examiner*—Charles E. Cooley
(74) *Attorney, Agent, or Firm*—Gardner Groff & Mehrman, P.C.

(57) ABSTRACT

A disposable disruptor device including a stator and a rotor. The rotor is disposed for rotation in the stator and has blades at one end thereof. A reverse-threaded helical ridge between the stator and the rotor pumps fluid down the stator and prevents fluid from being drawn up inside the stator tube.

3 Claims, 4 Drawing Sheets

SECTION 3-3

SECTION 8-8

DISPOSABLE DISRUPTOR AGITATOR TOOL HAVING A BLADED ROTOR DISPOSED IN A STATOR

BACKGROUND OFTHE INVENTION

1. Field of the Invention

This invention relates to the field of homogenizing, tissue disruption, and to a device which is particularly suited to tasks where risks of contamination must be minimized while keeping the sterilization process uncomplicated.

2. Description of Related Art

Many of today's protocols for the preparation of highly contaminant sensitive materials, such as gene research and hazardous disease studies, call for the utilization of mechanical shear and cavitation devices such as the Willems Polytron which was disclosed in U.S. Pat. No. 2,789,800. These devices generally feature a hollow outer shaft (stator) and a central inner shaft (rotor) extending axially through the outer shaft. The stator is formed at the lower end with a plurality of circularly arranged teeth, usually spaced at regular intervals. The lower end of the rotor generally includes a pair of downwardly extending teeth, which are in close proximity to the stator's teeth. When immersed in a mixture, and upon rotation of the rotor, the mixture is drawn in the rotor, and additional ultrasonic pressure field is set up within the mixture, thereby causing disintegration of the solid particles and resulting in homogenization of the mixture. The combination of these forces effectively circulate, disrupt, and dissolute solid particles into a homogenous liquid. This method of processing constitutes a majority of the approach used in the field of mechanical shear.

In the Willems Polytron and similar rotor-stator devices, windows were used in the tops and sides of the stators to allow pressure release in the upper stator. The need for windows can cause drainage from the top of the stator thus adding to material loss as well as possible contamination issues. However due to the high speeds at which this equipment runs and also viscosity of the media being processed, media tends to travel up inside the stator device. This is a tendency in all rotor-stator devices. If there are no windows in the stator, when the rotor spins at high speeds it is effectively sealed and a low pressure area is created in the top of the stator. The higher pressure of the fluid being processed allows the sample to rise higher in the tube and thus risk entering the motor.

BRIEF SUMMARY OF THE INVENTION

Using a simple principle that was demonstrated by Archimedes, a screw pump, and adapting the theory to our device we have come up with a unique approach to solve the fluid rising problem and resulting potential for eliminating sample contamination.

According to one preferred form, the present invention is a disposable disruptor agitator tool for processing a sample. The tool preferably includes a stator and a rotor defining an axis, the rotor preferably being disposed for rotation within the stator. One of the ends of the rotor preferably has four vanes adapted to couple to a drive means for rotating the rotor. The rotor preferably also has a screw thread on an outer portion thereof, the screw thread extending along a substantial portion of the rotor and configured to provide a reverse pumping action to the sample. Another end of the rotor preferably has two opposed blades for shearing the sample. The stator is preferably generally tubular in shape, with one end of the stator having L-shaped reliefs adapted to receive a mating adapter. The stator preferably also has circular pressure relief openings therein. Another end of the stator preferably has axially elongated openings extending therefrom for cooperating with the rotor blades to permit the sample to be expelled from the stator while shearing solid particles of the sample.

In a further preferred embodiment of the invention, the stator and rotor optionally are formed of plastic. In still another embodiment of the invention, the stator optionally has an enlarged portion at one of its ends, the enlarged portion having alternating recesses and ribs.

DETAILED DESCRIPTION OF THE INVENTION

Figure 1:
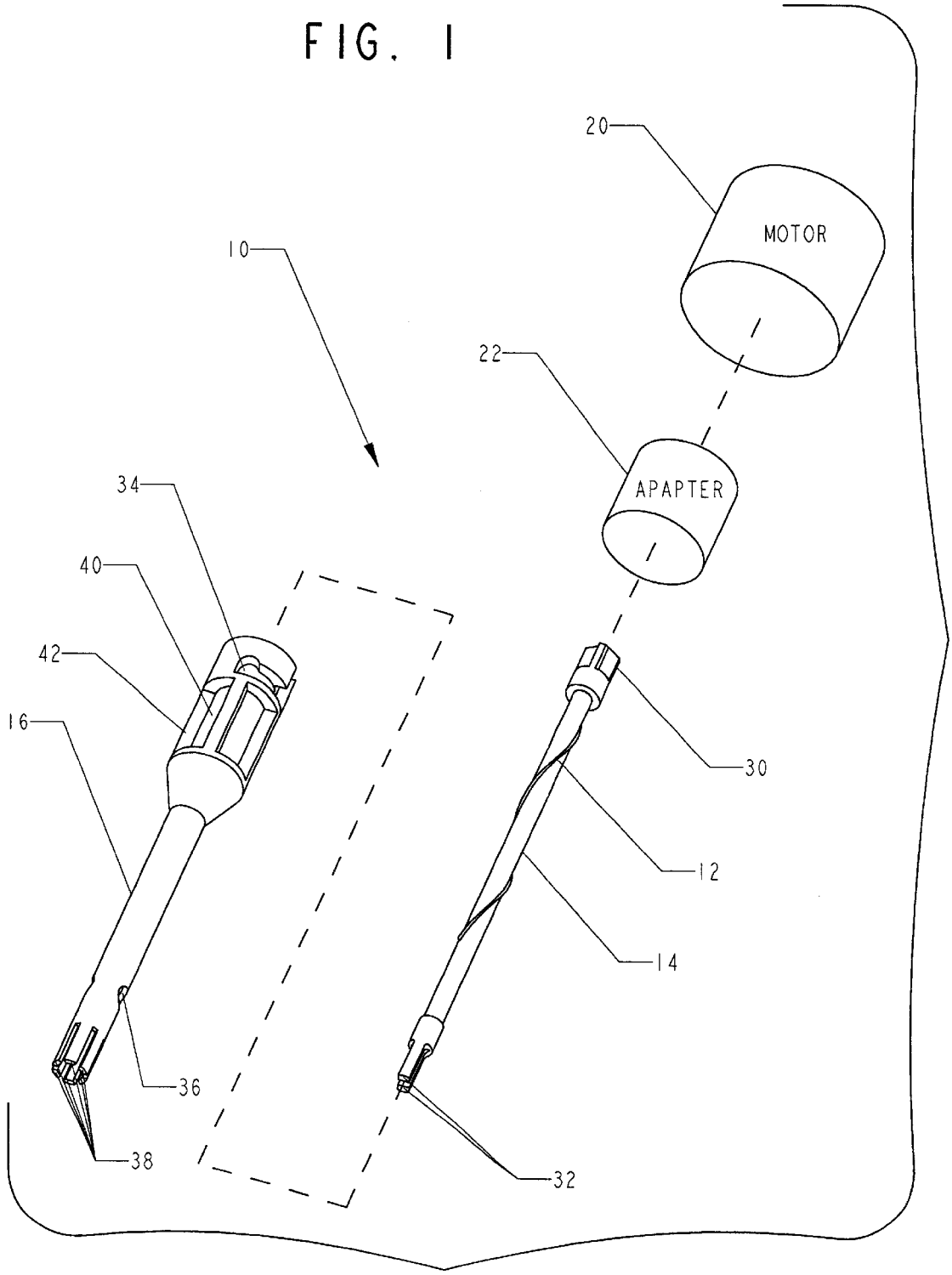
FIG. 1. Isometric view of disrupter device unassembled.
Figure 2:
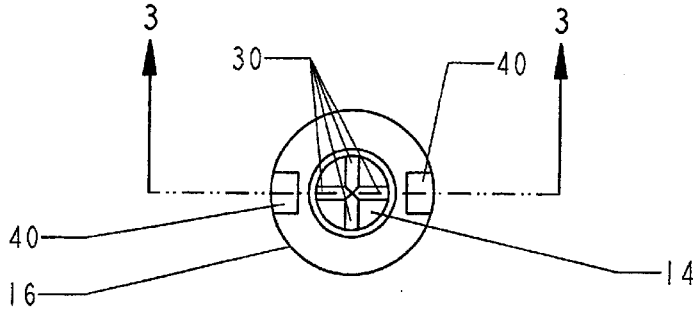
FIG. 2. End view of the assembled device along view lines 2—2.
Figure 3:
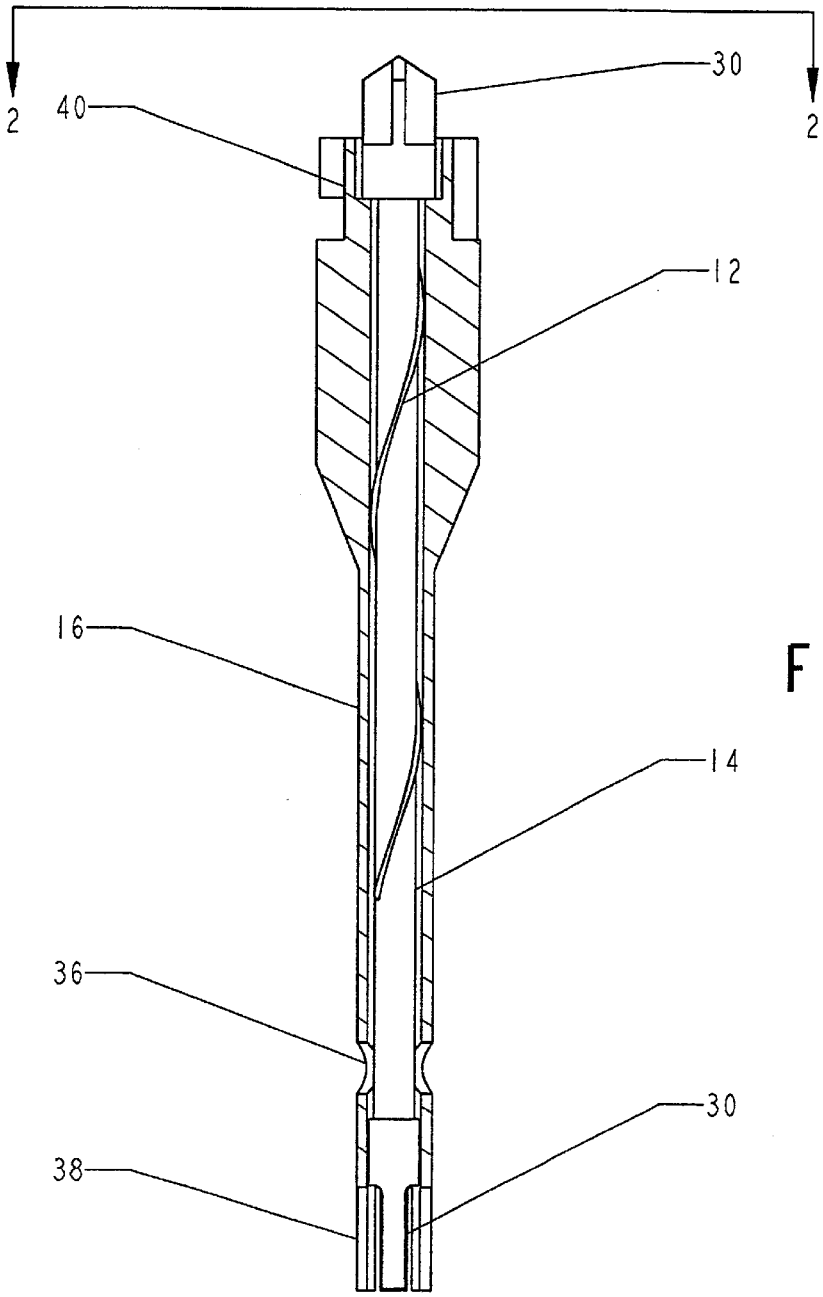
FIG. 3. Sectional view taken along line 3—3 of FIG. 2.
Figure 5:
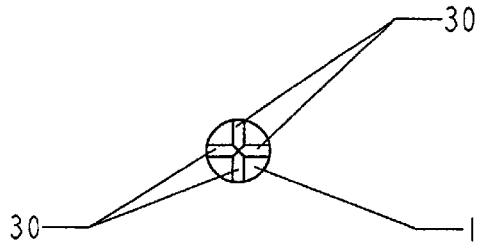
FIG. 5. End view of the rotor of FIG. 4, along view lines 5—5.
Figure 4:
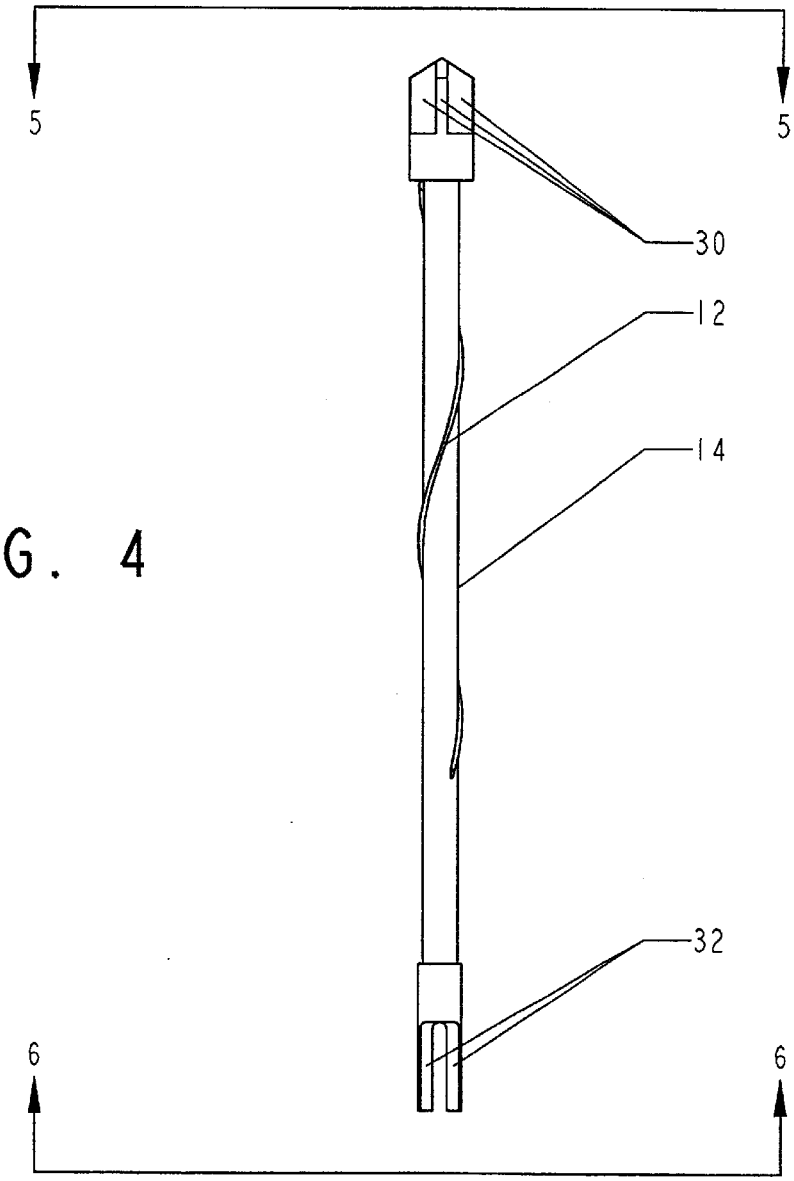
FIG. 4. Detail of rotor shaft showing downflow ridge.
Figure 6:
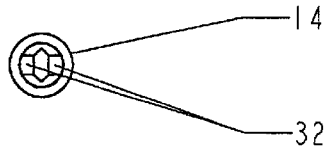
FIG. 6. End view of the rotor of FIG. 4, along view lines 6—6.
Figure 9:
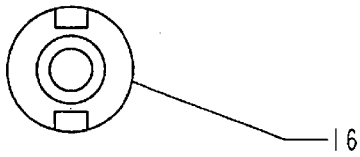
FIG. 9. End view of the stator of FIG. 7, along view lines 9—9.
Figure 7:
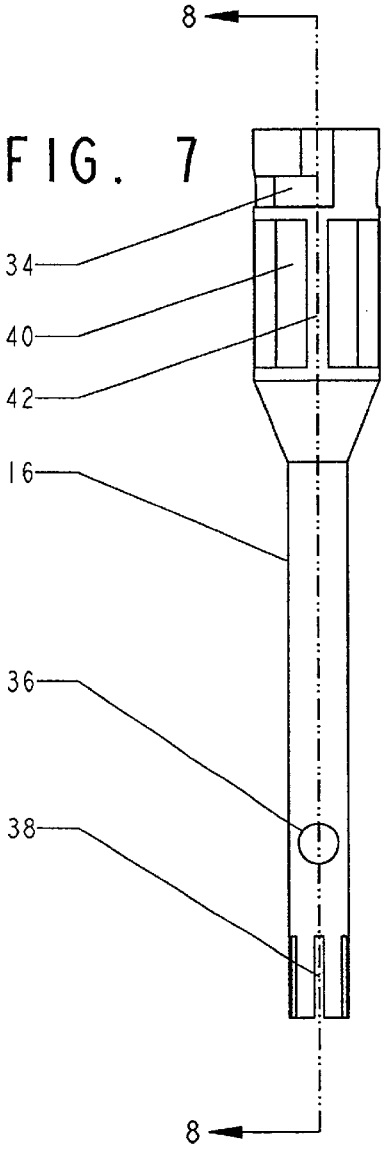
FIG. 7. Detail of stator with new coupling end.
Figure 8:
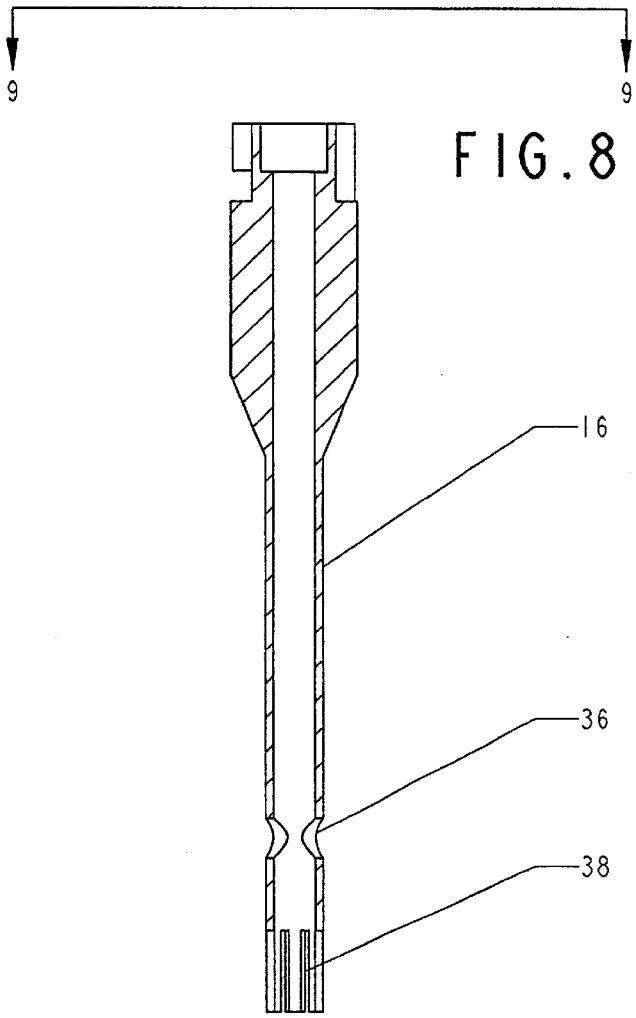
FIG. 8. Cross-sectional view of the stator of FIG. 7.

While the Willems Polytron is an effective means of cell disruption, the multiplicity of teeth and channels for liquid flow make cleaning of the device particularly difficult. Many of the materials frequently sought in current biotechnology applications, such as DNA or RNA extractions and disease research, require extreme sterility. When disrupting material for a biopsy in the operating room, sterility requirements make it imperative that the risk of contamination or cross contamination between samples be eliminated. Current sterilization techniques are time consuming and therefore expensive, and fall short of guaranteeing the elimination of cross contaminants. This becomes particularly critical when dealing with micro samples, where the ratio of sample to potential contaminant is extremely low. The Willems Polytron is very effective but due to the materials available at its invention and today's new materials innovation its is possible to create a new approach to this device. In laboratories that do gene research and disease research disposability is key. For example, the fluids these devices can come in contact with can be highly hazardous and similar to syringes and needles should not reused. However, for lower processing standards the nature of the plastics will allow sterilization, such as autoclavability and sterilization with Gamma radiation for less sensitive work.

In homogenization devices, such as the Willems Polytron, the most effective homogenization occurs in flow through the blades. As disclosed in U.S. Pat. No. 2,541,221, these devices can be considered mixing devices which use the stator to aid in the flow of media around the container. Our invention localizes the flow of media to the lower end of the rotor-stator. In normal laboratory work using a rotor-stator device would coat the inside and outside of the tube with the media, causing great expense due to loss of sample material and possible cross contamination. In certain applications where genes and disease research tests are done, the sizes of the sample are very small and critical. Due to size and materials used these older mixers are obsolete for these tasks. What is needed is a small portable disposable rotor-stator that can be transported and disposed of easily and cost effectively.

One side effect of the shearing process occurs when the rotor spins at high speeds. Due to the rotation of the rotor and the viscosity of the fluid that is being processed, the sample can be drawn in to the rotor and continue into the motor. This occurs due to low pressure zone created by the spinning of the shaft inside the tube and the higher pressure fluid surrounding the tube being pushed up the stator.

The present invention offers a unique solution to this problem. The nature of the plastic from which the device 10 of the present invention is preferably fabricated allows a half-circular ridge 12 to be placed on the rotor 14 that effectively pumps fluid down the stator 16 while not disrupting the homogenization process. This half-circular ridge 12 also effectively eliminates the chances for fluid to enter the motor since the fluid level in the shaft of the device 10 is always at or below the level of the surrounding vessel.

The present invention thereby provides an improvement over the Willems Polytron device. In preferred form, the present invention is a simple device 10 which is first shipped in sterile packaging, only has two parts and is manufactured to be economically disposable. This was not anticipated by Willems since he describes a device which can be operated for long periods of time without requiring extensive and costly maintenance or servicing. Nor was the need for sterility and the elimination of cross contamination as critically understood in 1957, as it is in todays biotechnology applications. In fact, protocols such as the Promegas-Protocol and Applications guide which recommend the use of a Polytron type system, also specifically state that "whenever possible, sterile disposable plasticware should be used for handling RNA". The disposable disruptors of the present invention offer a unique solution to this statement. The introduction of a thread or ridge 12 also keeps the inside of the adapter 22 and motor 20 from being contaminated where it is hardest to sterilize. By utilizing the advanced engineering plastics, chosen for strength and moldability, for the rotor 14 and stator 16 a unique disposable plasticware solution for the previously described contamination problem has been created. A further benefit of the use of this material is that the stator 16 can be manufactured from a clear material that is resistant to heat and gamma radiation, thereby enhancing cleanability for the applications where contamination is a lesser issue, and where it may be useful to reuse the device 10.

By utilizing a simple, spring action quarter turn adapter 22, the device can be quickly installed and discarded, without concerns about cross threading the plastic material, as would occur if conventional screw thread adaptation were utilized. This adapter 22 is also suitable for fastening the device 10 to a multiplicity of currently available drive motors 20 of various manufacturers, thereby making it economically useful to a broad range of practitioners without the need for purchasing new homogenizing equipment. The unique use of a reverse thread or ridge 12 protects the adapter and motor from being damaged.

The tool 10 if the present invention preferably includes a stator 16 and a rotor 14 defining an axis, the rotor 14 preferably being disposed for rotation within the stator 16. One of the ends of the rotor 14 preferably has four vanes 30 adapted to couple to a drive means, such as a motor 20, for rotating the rotor 14. The rotor 14 preferably also has a screw thread or ridge 12 on an outer portion thereof, the screw thread extending along a substantial portion of the rotor 14 and configured to provide a reverse pumping action to the sample. Another end of the rotor 14 preferably has two opposed blades 32 for shearing the sample. The stator 16 is preferably generally tubular in shape, with one end of the stator 16 having L-shaped reliefs 34 adapted to receive a mating adapter 22. The stator preferably also has circular pressure relief openings 36 therein. Another end of the stator preferably has axially elongated openings 38 extending therefrom for cooperating with the rotor blades 32 to permit the sample to be expelled from the stator 16 while shearing solid particles of the sample.

In a further preferred embodiment of the invention, the stator 16 and rotor 14 optionally are formed of plastic. In still another embodiment of the invention, the stator 16 optionally has an enlarged portion at one of its ends, the enlarged portion having alternating recesses 40 and ribs 42.

While the invention has been described with reference to preferred and example embodiments, it will be understood by those skilled in the art that a number of modifications, additions and deletions are within the scope of the invention, as defined by the following claims.

We claim:

1. A disposable disruptor agitator tool for processing a sample comprising:

a stator and a rotor defining an axis, said rotor disposed for rotation within said stator, one of the ends of said rotor having four vanes adapted to couple to a drive means for rotating said rotor, said rotor having a screw thread on an outer portion thereof, said screw thread extending along a substantial portion of said rotor and configured to provide a reverse pumping action to the sample, another end of said rotor having two opposed blades for shearing the sample;

said stator being generally tubular in shape, one end of said stator having L-shaped reliefs adapted to receive a mating adapter, said stator having circular pressure relief openings therein, another end of said stator having axially elongated openings extending from said another end for cooperating with said rotor blades to permit the sample to be expelled from the stator while shearing solid particles of the sample.

2. The agitator tool of claim 1, wherein the stator and rotor are formed of plastic.

3. The agitator tool of claim 1, wherein the stator has an enlarged portion at one of said ends, said enlarged portion having alternating recesses and ribs.

* * * * *